US005791307A

United States Patent [19]

Helmin

[11] Patent Number: 5,791,307

[45] Date of Patent: Aug. 11, 1998

[54] VARIABLE LIFT AND TIMING SYSTEM FOR VALVES

[76] Inventor: Ruben Helmin, Grasparvsgatan 19, 26050 Billesholm, Sweden

[21] Appl. No.: 815,228

[22] Filed: Mar. 12, 1997

[51] Int. Cl.[6] ..... F01L 1/34

[52] U.S. Cl. ..... 123/90.63

[58] Field of Search ..... 123/90.61, 90.63, 123/90.48, 90.55, 90.57

[56] References Cited

U.S. PATENT DOCUMENTS

| | | | |
|---|---|---|---|
| 1,624,497 | 4/1927 | McAllister | 123/90.63 |
| 2,672,132 | 3/1954 | Randol | 123/90.61 |
| 2,694,389 | 11/1954 | Turkish | 123/90.62 |
| 3,109,418 | 11/1963 | Exline et al. | 123/90.63 |
| 3,418,983 | 12/1968 | Hans-Jurgen Sossna | 123/90.63 |
| 4,151,824 | 5/1979 | Gilbert | 123/90.61 |
| 4,407,241 | 10/1983 | Butler et al. | 123/90.57 |
| 4,602,597 | 7/1986 | Rhoads | 123/90.63 |
| 5,394,843 | 3/1995 | Decuir | 123/90.61 |

*Primary Examiner*—David A. Okonsky
*Attorney, Agent, or Firm*—James E. Brunton

[57] ABSTRACT

A system for controlling the opening and closing, as well as the lift, of the intake and exhaust valves of an internal combustion engine as a function of the speed of the engine. In one form of the invention, the system includes a variable length tappet assembly which, in cooperation with a push rod and rocker assembly, functions to open and close the valves of the engine in direct relation to engine speed. The variable length tappet assembly is operably coupled with the oil pump of the engine, the output pressure of which varies as a function of engine speed with the result that the overall length of the tappet assembly also varies as a function of engine speed.

13 Claims, 8 Drawing Sheets

VARIABLE LIFT AND TIMING SYSTEM FOR VALVES

BACKGROUND OF THE INVENTION

1. Field of the Invention

The present invention relates generally to the variable lift and timing of valves in internal combustion engines. More particularly, the invention concerns a system for controlling the opening and closing of the valves as well as for controlling the lift of the valves as a function of an engine speed.

2. Discussion of the Prior Art

In an internal combustion engine of the four stroke type, the phase of the engine cycle during which the intake and exhaust valves of the engine are open is usually referred to as valve timing. In a conventional engine the valve timing is typically fixed and does not vary with respect to engine speed. Since the dynamic behavior of the flow of gasoline into the cylinder varies considerably over the engine operating range, the fixed valve timing must, of necessity, be a compromise setting. In such a case, the fixed timing can be optimum only for a particular engine performance characteristic at a particular operating condition. For example, the fixed timing might be tailored for high output power at high speed at the expense of lower fuel consumption. Conversely, the fixed timing might be tailored to achieve minimum exhaust emissions or maximum fuel economy at the expense of power at high speed.

As is well understood by those skilled in the art of internal combustion engine design, an increase in power output can be achieved by increasing the opening time (duration) of the valves of the engine. Further, by increasing the extent of valve lift in proportion to duration, there will be less restriction in the valve area which will further enhance the filling and emptying of the cylinders. Accordingly, engines designed for racing require substantial valve opening duration and valve lift for peak performance. By way of example, the inlet valve in typical racing engines may open 80 degrees before top dead center and close 70 degrees after bottom dead center. Similarly, the exhaust valve may open 70 degrees before bottom dead center and close 50 degrees after top dead center. Longer duration for both inlet and exhaust is thereby achieved.

On the other hand, engines designed for normal passenger car use, which must be efficient at low speeds, are typically designed so that the inlet valves open at 25 degrees before top dead center, and close 45 degrees after bottom dead center. Similarly, the exhaust valves typically open 45 degrees before bottom dead center and close 30 degrees after top dead center thereby achieving a duration for both inlet and exhaust valves.

As is also well understood by those skilled in the art, late closing of inlet valves at higher engine revolutions per minute (rpm) will make better use of the kinetic energy in the incoming mixture of air and fuel. However, at lower rpm and at idle, some of the filling will be pushed back into the inlet channel. This condition creates increased emissions of hydrocarbon and fuel consumption, as well as uneven running. Power at low rpm is also decreased because of the loss of volumetric efficiency.

Additionally, the flow of exhaust gases through the exhaust valve is critical at the opening stage and benefits from longer durations at higher rpm. At lower rpm there is typically a loss of pressure energy by early opening that must be weighted against the loss at higher rpm caused by increased pressure meeting the piston during the exhaust stroke. Clearly, therefore, in actual practice, the engine designer must settle on some type of compromise between efficiency at either high or low engine speeds.

It is also well recognized that by permitting the closing of the exhaust valve to overlap the opening of the inlet valve, a significant increase in power can be accomplished. Therefore, by careful use of a large overlap of the exhaust valve, it is possible to make use of pressure pulsations in the sound waves that are created in both the inlet and exhaust systems. From the foregoing, it is apparent that the benefits of a progressive system that allows very small lift and very short duration of opening time also makes it possible to regulate the power output without strangling the effect of the throttle. By closing the inlet valve early, before bottom dead center, the compression cycle that follows will start from a lower level. This results in a lower peak combustion temperature and a reduction of nitrogen oxide emissions.

Because of the obvious drawbacks of fixed timing, and in light of the substantial advantages that can be realized by controlling valve lift and the opening duration of the valves of the engine, substantial effort has been directed in the past to the development of systems which will permit the timing to be varied as a function of engine operation. For example, U.S. Pat. No. 5,289,806 issued to Hurr, suggests the use of an axially shiftable camshaft to accomplish optimum valve opening and closing times for particular engine operating conditions. In a somewhat similar vein, U.S. Pat. No. 5,445,116 issued to Hara suggests a camshaft supported in an engine cylinder head structure which has a low speed cam lobe and a high speed cam lobe which are used selectively to accomplish variable valve timing.

U.S. Pat. No. 5,404,770 issued to Kruger discloses a somewhat different approach. More particularly, Kruger suggests a variable cam arrangement for a lift valve which includes a cam having a rigid part which is movable on a camshaft in a radial direction between a retracted and an extended position. In another vein, the prior art Matsumo U.S. Pat. No. 5,078,102 discloses an engine valve driving device which includes a rocker arm attached at one end to a valve stem and carrying at its opposite end a roller which engages the surfaces of a stepped cam plate. The cam plate has a horizontal surface which includes upper and lower portions joined by an inclined portion so that horizontal reciprocating motion operates the rocker arm and the connected valve. The cam plate is connected to a rotary cam crankshaft so that rotation of the crankshaft produces linear reciprocating motion in the cam plate. The connection between the camshaft and the cam plate is adjustable, as by a hydraulic cylinder, to vary the gap between the cam plate and the camshaft and to thereby vary the timing of the motion of the valve with respect to the rotation of the camshaft.

Other prior art patents suggesting still other approaches to controlling valve timing include U.S. Pat. No. 5,551,021 issued to Moore; U.S. Pat. No. 5,361,736 issued to Phoenix et al and U.S. Pat. No. 5,483,930 issued to Moriya et al.

While the prior art attempts at designing systems for controlling valve duration and valve lift as a function of engine speed have met with some degree of success, numerous problems have been encountered in actually bringing the systems to commercial fruition. For example, many of the systems suggested in the past have been quite complicated and have exhibited marginal reliability in actual operation. Other prior art systems have been simply too difficult and costly to manufacture thereby making them unattractive to commercial engine developers.

As will be better appreciated from the description which follows, the apparatus of the present invention uniquely overcomes most of the drawbacks of the prior art and provides an elegant, extremely simple and highly cost effective means for effectively controlling valve lift and duration as a function of engine speed.

SUMMARY OF THE INVENTION

It is an object of the present invention to provide a simple, cost effective and highly reliable system for controlling the opening and closing, as well as the lift, of the intake and exhaust valves of an internal combustion engine as a function of the speed of the engine.

Another object of the invention is to provide a system of the aforementioned character in which the system includes a novel variable length tappet assembly which, in cooperation with a unique push rod and rocker assembly, functions to open and close the valves of the engine in direct relation to engine speed.

Another object of the invention is to provide a system as described in the preceding paragraph in which the variable length tappet assembly is operably coupled with the oil pump of the engine, the output pressure of which varies as a function of engine speed with the result that the overall length of the tappet assembly also varies as a function of engine speed.

Another object of the invention is to provide a system of the character described in which the valves of the engine are automatically controlled by the system of the invention in a manner to produce optimum engine performance both at high and low speeds.

Another object of the invention is to provide a system for controlling the opening and closing of the engine valves as a function of engine speed, which is of straight forward design and is easy to manufacture and maintain.

These and other objects of the invention are achieved by a valve operating system for use in combination with an internal combustion engine which includes a push rod having first and second ends, the first end being engagable by the rocker of the engine; a variable length tappet assembly disposed intermediate the rotating camshaft of the engine and the second end of said push rod; and operating means operably associated with the variable length tappet assembly for varying the length of the tappet assembly as a function of the speed of the engine. In one embodiment of the invention, the operation means includes an oil flow passageway which interconnects the variable length tappet assembly with the oil pump of the engine so that as the pressure of the oil flowing from the oil pump varies as a function of engine speed, the overall length of the tappet assembly will vary correspondingly.

DESCRIPTION OF THE INVENTION

Figure 1:
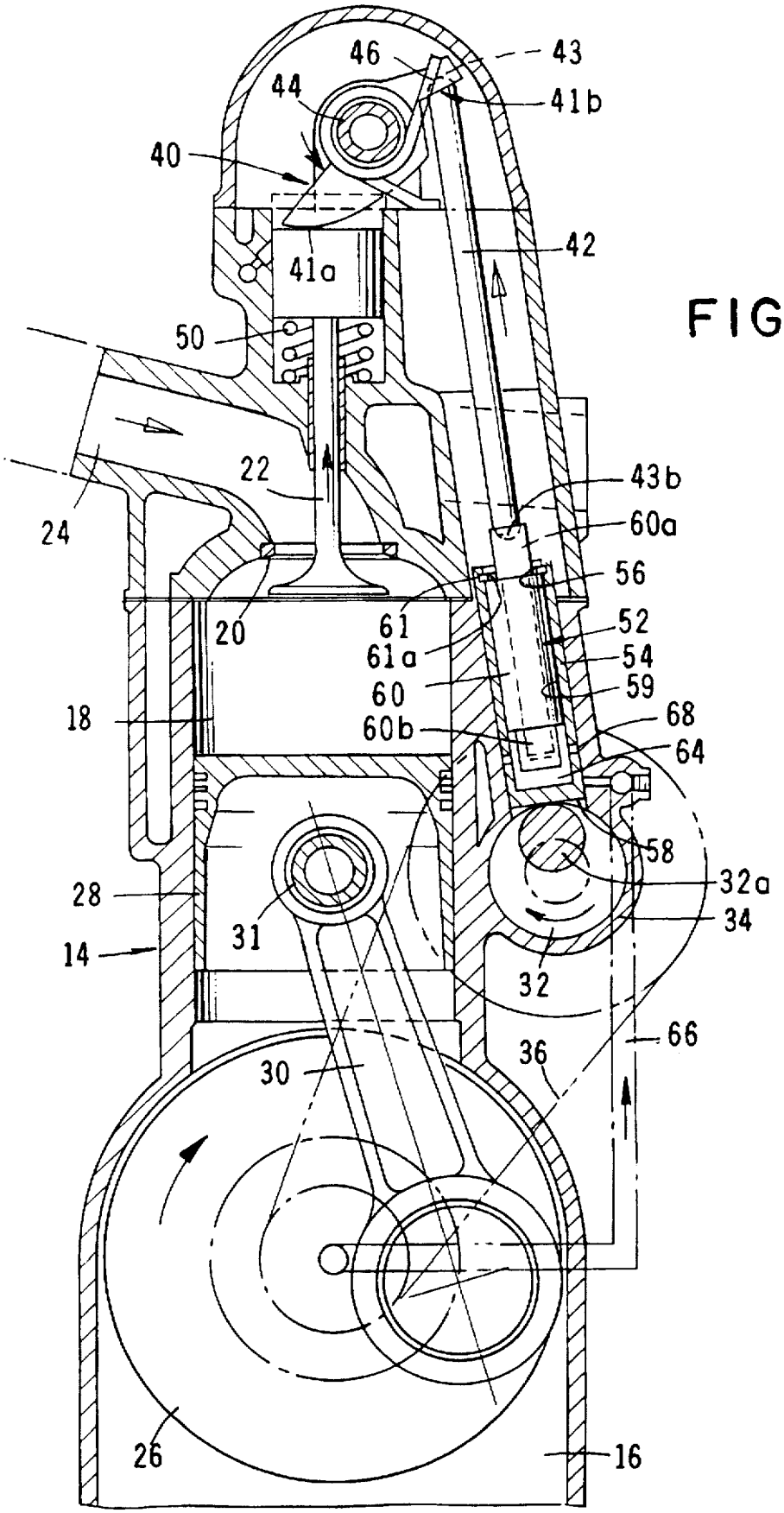
FIG. 1 is a generally diagrammatic, side-elevational, cross-sectional view of a portion of an internal combustion engine operating at a first speed and embodying one form of the valve operating means for controllably operating the engine valves.
Figure 2:
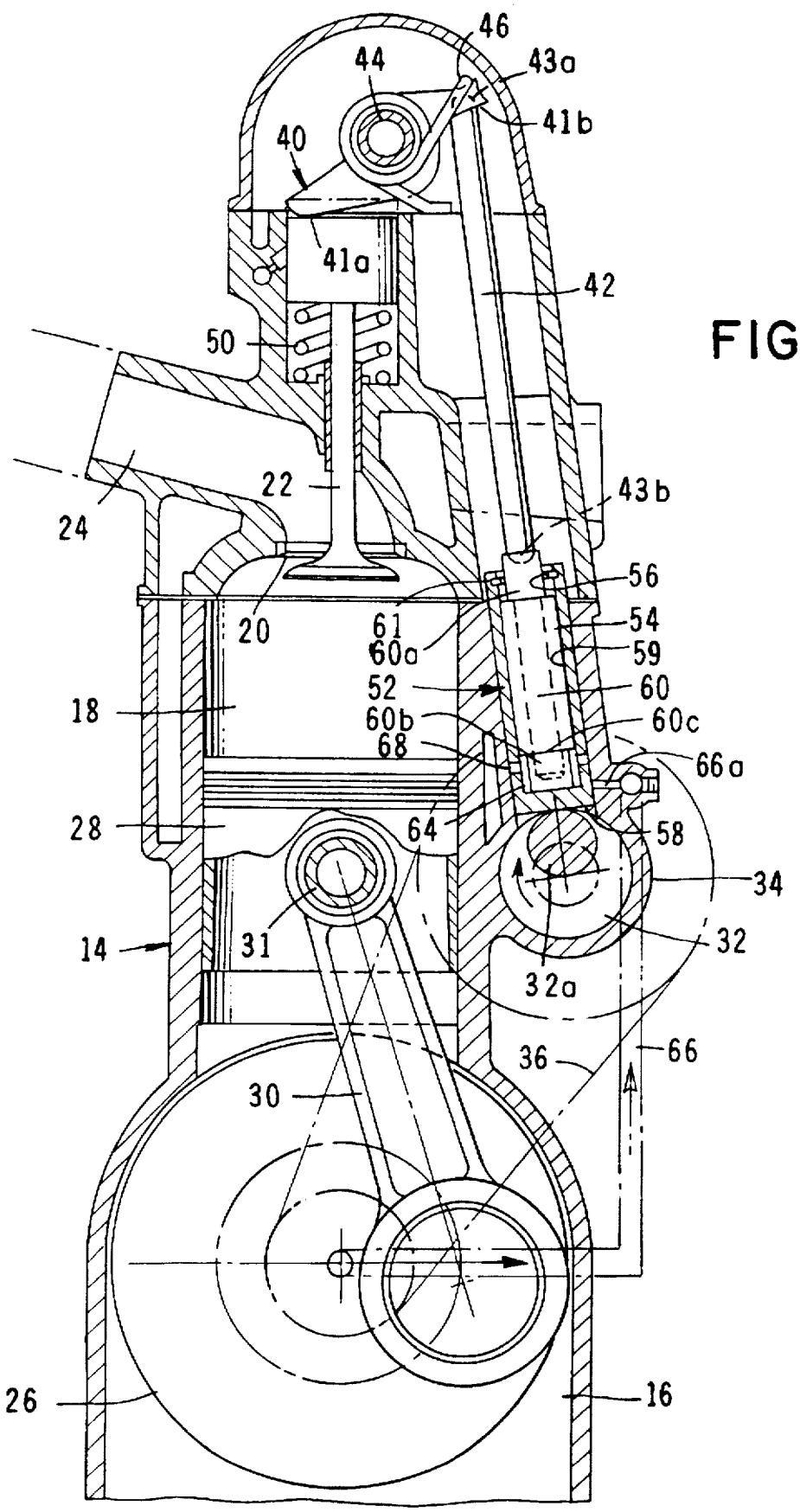
FIG. 2 is a view similar to FIG. 1, but showing the engine operating at second lower speed and with the variable length tappet assembly of the valve operating means in a different position from that shown in FIG. 1.
Figure 3:
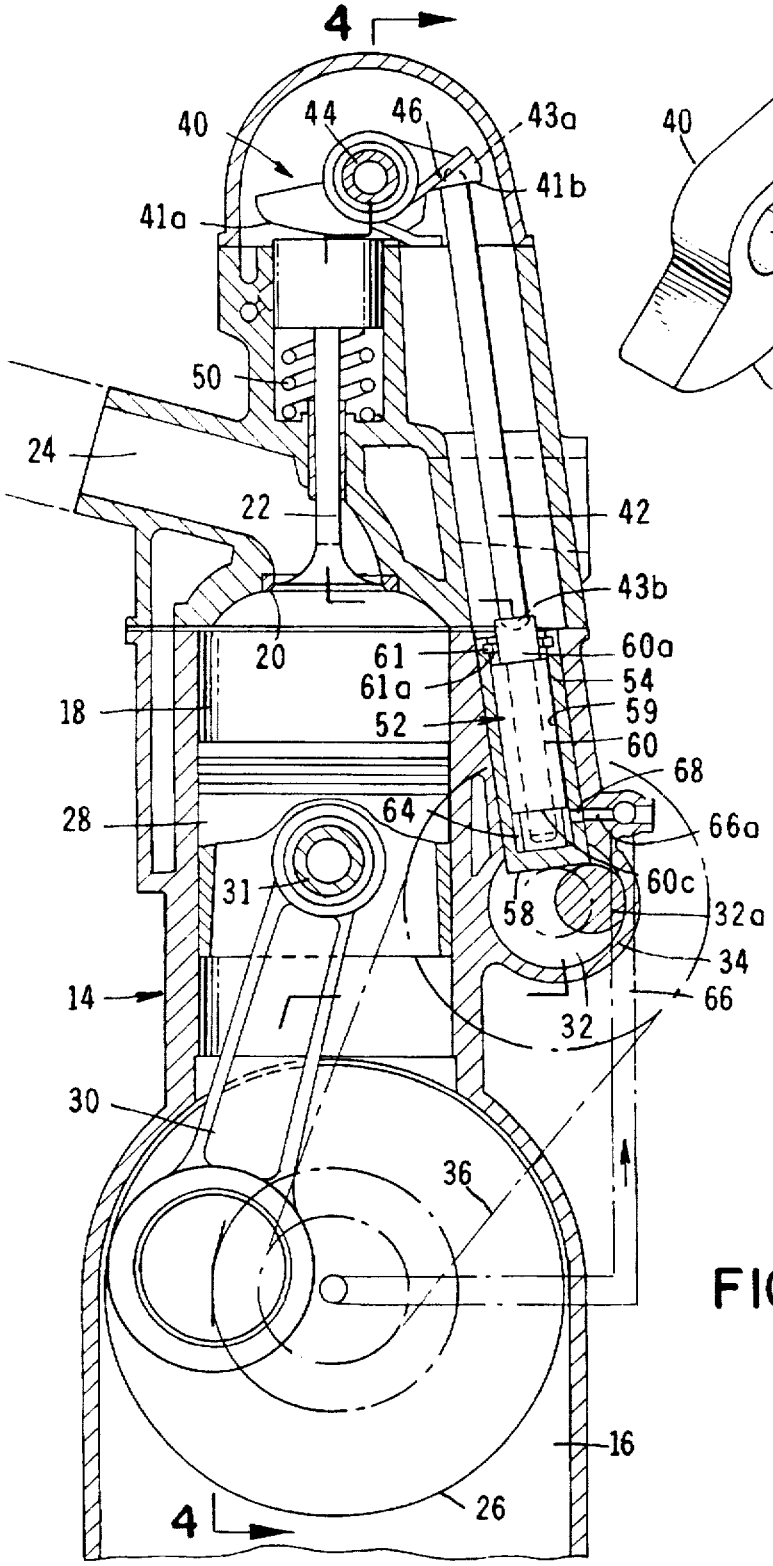
FIG. 3 is a view similar to FIG. 2, but showing the tappet assembly of the valve operating apparatus in still a different position wherein the valves of the engine are closed and the overall length of the tappet assembly is at a minimum.
Figure 4:
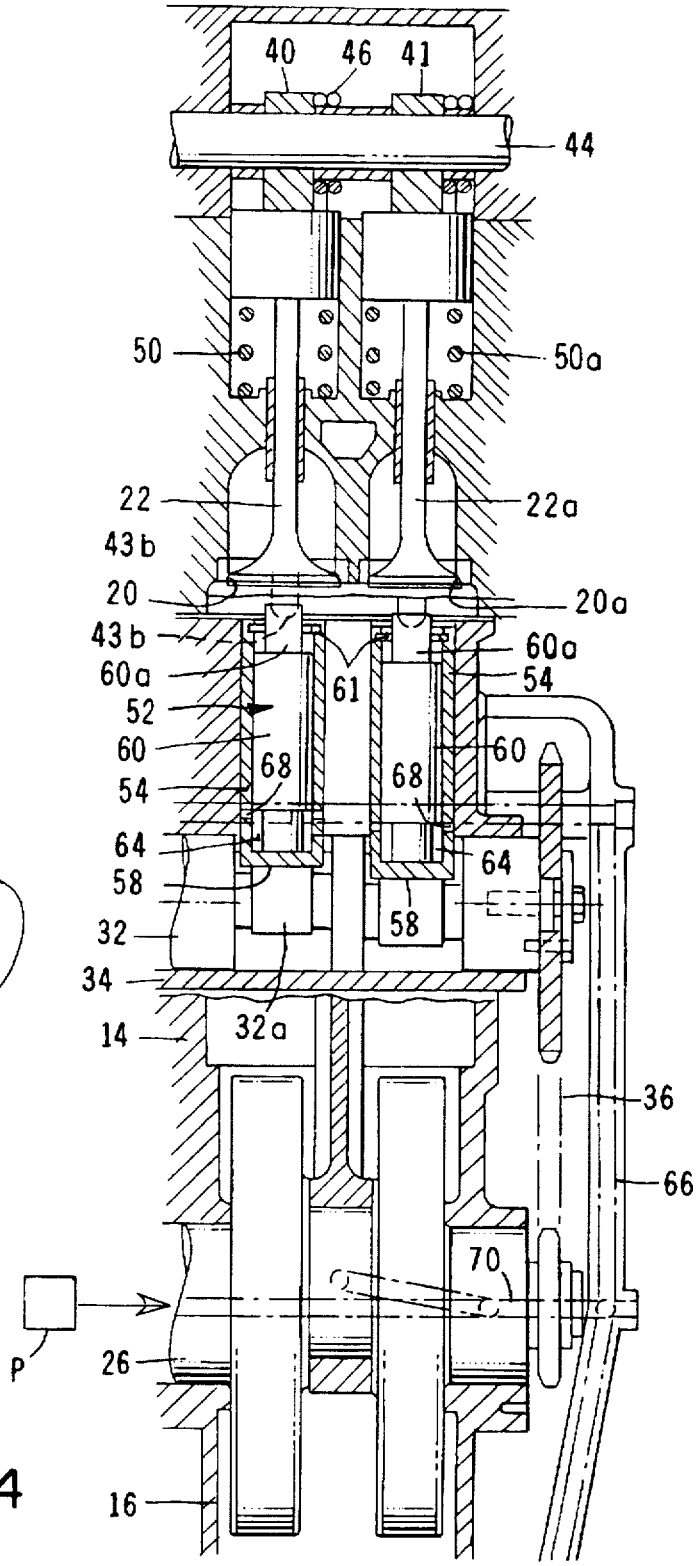
FIG. 4 is a cross-sectional view taken along lines 4—4 of FIG. 3.

Referring to the drawings and particularly to FIGS. 1 through 3, the intake portion of one embodiment of the internal combustion engine of the present invention is there illustrated. As shown in FIG. 4, the engine also includes an exhaust portion comprising operating components of substantially identical design. For simplicity of explanation, the components of the intake portion of the engine will first be described. In the embodiment of the invention shown in the drawings, the engine comprises a housing 14 having a crankcase 16 and a combustion chamber 18. Provided within combustion chamber 18 is a valve seat 20 which, in cooperation with a valve 22, functions to close a fuel inlet passageway 24. Valve 22 is movable toward and away from valve seat 20 in the manner illustrated in FIGS. 1 through 3.

A crankshaft 26 of generally standard construction is rotatable within crankcase 16 and is interconnected with a conventional piston 28 by means of a connecting rod 30 and a wrist pin 31. Piston 28 reciprocates within combustion chamber 18 as the engine passes through its various operating cycles. A rotating camshaft 32 of generally standard construction is rotated within a camshaft housing 34 which forms a part of engine housing 14. Drive means, shown here as a drive belt 36, interconnects crankshaft 26 with camshaft 32 in a manner to controllably impart rotation to the camshaft as the crankshaft rotates within crankcase 16.

Figure 9:
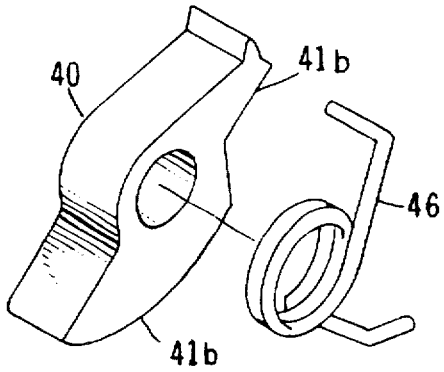
FIG. 9 is a generally perspective view of the rocker and cooperating biasing means of the apparatus of one form of the invention.

A rocker 40 is operably associated with valve 22 in the manner shown in the drawings for imparting substantially linear movement to the valve in a direction toward and away from valve seat 20. More particularly, as shown in FIGS. 1 and 9, rocker 40 is provided with a valve engaging curved surface 41*a* and a second spaced-apart surface 41*b* which is engagable with the outboard end 43*a* of a pusher rod 42. Rocker 40 pivots about a shaft 44 which also carries a biasing means shown here as a torsion spring member 46, the purpose of which will presently be described (see also FIG. 4).

Referring particularly to FIG. 4, it is to be noted that, in addition to valve 22 which moves toward and away from valve seat 20 so as to control fuel inlet passageway 24 of the intake portion of the engine, there is provided an outlet valve 22*a* which opens and closes valve seat 20*a* to regulate the flow of exhaust gases through the exhaust port of the exhaust portion of the engine. Similarly, a rocker 41 pivots about shaft 44 and controls and imparts substantially linear movement to exhaust valve 22*a*. Intake and exhaust valves 22 and 22*a* are of substantially identical design and operate in a conventional manner with both valves being continuously biased into a closed position by springs 50 and 50*a* respectively which are mounted on shaft 44 (FIG. 4).

Basically, the engine components described in the preceding paragraphs are of standard construction and operate in a standard manner. The improvement and the unique, nonstandard aspect of the internal combustion engine of the invention comprises a novel valve operating means for controllably operating the intake and exhaust valves as function of engine speed. As best seen by referring to FIGS. 1 and 10, the novel valve operating means of this form of the invention comprises an assembly made up of the previously identified push rod 42 and a variable length tappet assembly 52 which is disposed intermediate rotating camshaft 32 and the second or lower end 43*b* of the push rods. As shown in FIG. 4, a valve operating apparatus is provided to operate each of the intake and exhaust valves 22 and 22*a* respectively. These valve operating assemblies are of substantially identical construction and operate in substantially the same manner. This being the case, in the paragraphs which follow only the assembly associated with the intake valve will be described.

Figure 10:
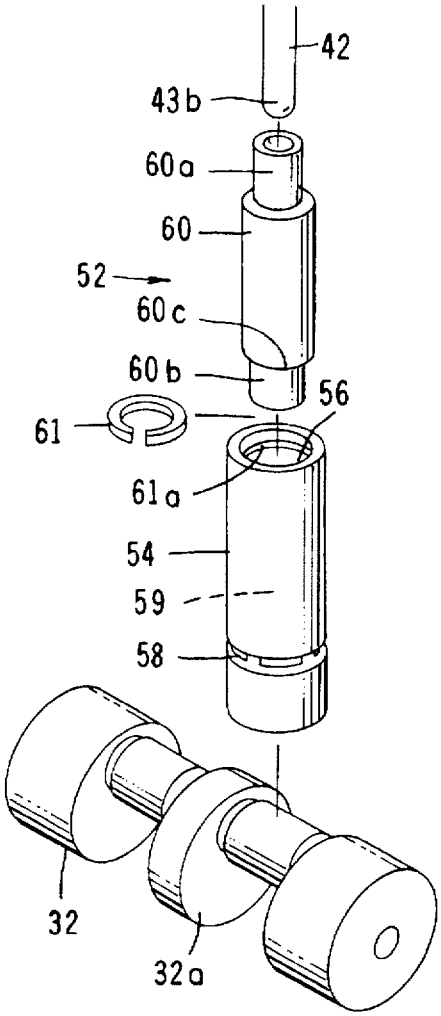
FIG. 10 is a generally perspective exploded view of one form of the valve operation means of the invention, showing the adjustable length tappet assembly, a portion of the camshaft and a portion of the push rod.

Turning particularly to FIG. 10, the variable length tappet assembly 52 can be seen to comprise a hollow sleeve 54 having a first open end 56 and a closed end 58, which is engagable with a selected lobe 32*a* of camshaft 32 in the manner shown in FIG. 1. Reciprocally movable within the internal chamber 59 of sleeve 54 is a push rod engaging member 60. Member 60 has a reduced diameter first end portion 60*a* adapted to engage end 43*b* of push rod 42 and a spaced-apart reduced diameter second end portion 60*b* which resides within hollow sleeve 54. Alignment means, shown here as a split washer 61, is received within a groove 61*a* formed internally of sleeve 54. Washer 61 functions to align member 60 within chamber 59 and guide its reciprocal movement therewithin.

Figure 7:
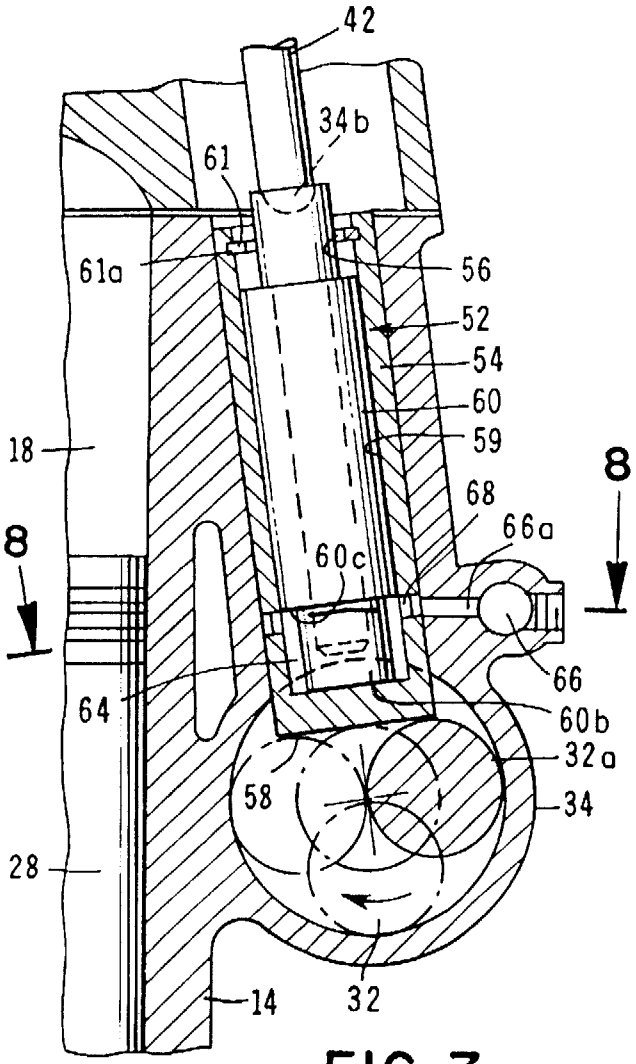
FIG. 7 is an enlarged, cross-sectional view of the tappet assembly and camshaft portions of the apparatus illustrated in FIG. 3 showing the tappet assembly in a configuration of minimum overall length.

As best seen in FIG. 7, end portion 60*b* of push rod engaging member 60 forms, in cooperation with hollow sleeve 54, an oil reservoir 64. In a manner presently to be described, oil reservoir 64 communicates with the oil pump of the engine via an oil flow passageway 66 which also forms a part of the valve operating means of the present form of the invention. In this regard, it is important to understand that reservoir 64 can communicate with oil passageway 66 only when sleeve 54 is in the almost instantaneous position shown in FIG. 7, wherein a circumferentially extending fluid inlet 68, which is formed in the wall of sleeve 54, is in alignment with the fluid outlet portion 66*a* of oil flow passageway 66. Referring to FIGS. 3, 4, and 7, it is to be noted that inlet 68 aligns with outlet 66*a* only when camshaft 32 is in the position shown in these figure drawings. In this substantially instantaneous position, the cam lobe 32*a* is exerting no upward force on sleeve 54, and both the intake and exhaust valves 22 and 22*a* are in their closed position (FIG. 4).

Figure 8:
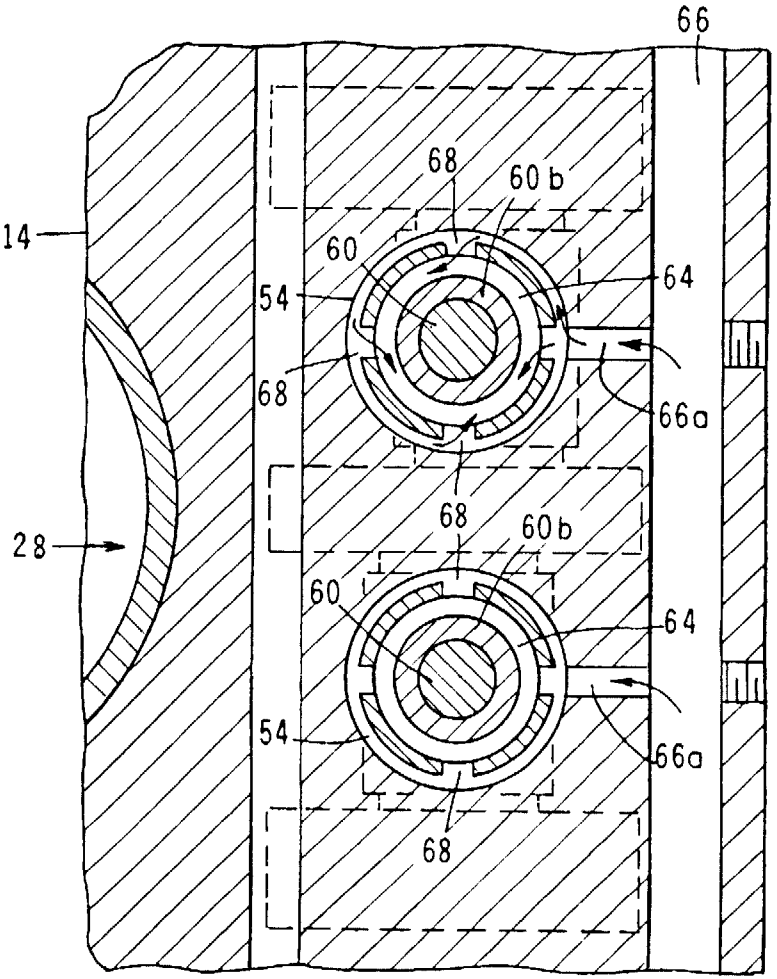
FIG. 8 is a cross-sectional view taken along lines 8—8 of FIG. 7.

As illustrated in FIGS. 3, 7 and 8, the instant in time at which fluid outlet 66*a* aligns with inlet 68, oil under pressure flowing through passageway 66 can flow into reservoir 64. As can be seen by also referring to FIG. 4, passageway 66 is in communication with an axially extending fluid passageway 70 formed in crankshaft 32, which passageway is in communication with the oil pump of the engine. As previously mentioned, the oil pump "P" of the engine (FIG. 4) is designed to deliver oil to the engine components at a pressure which is in direct proportion to the speed of the engine and the rpm of the crankshaft 26. Accordingly, when outlet 66*a* is aligned with inlet 68, the pressure of oil flowing into reservoir 64 from oil pump "P" will vary directly with the speed of the engine and the rpm of crankshaft 26.

Figure 6:
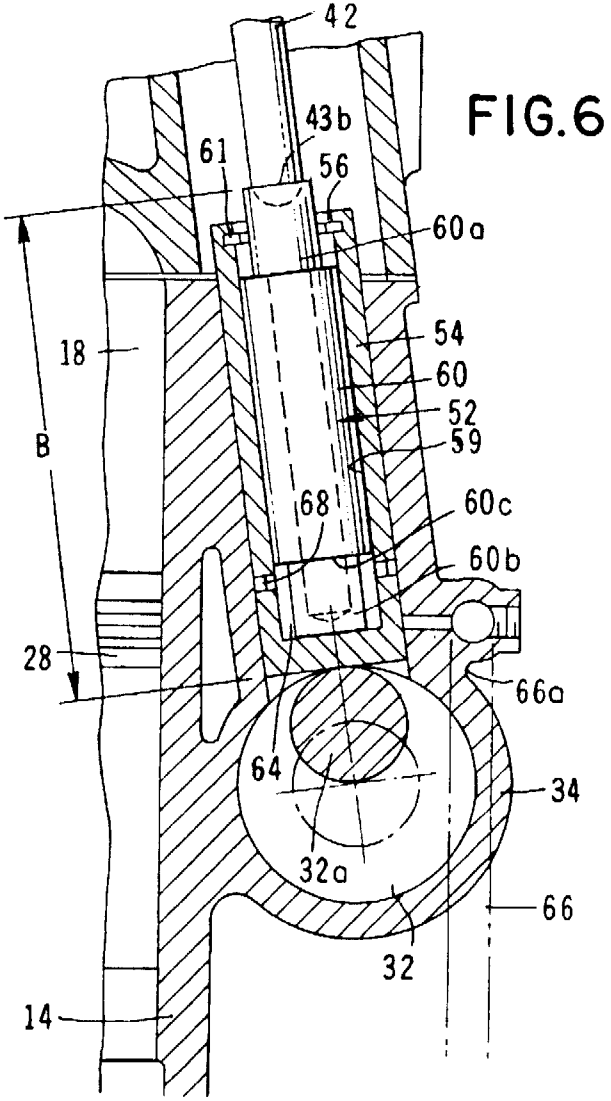
FIG. 6 is an enlarged, cross-sectional view of the tappet assembly and camshaft portions of the apparatus illustrated in FIG. 2 showing the overall length of the tappet assembly as "B".
Figure 5:
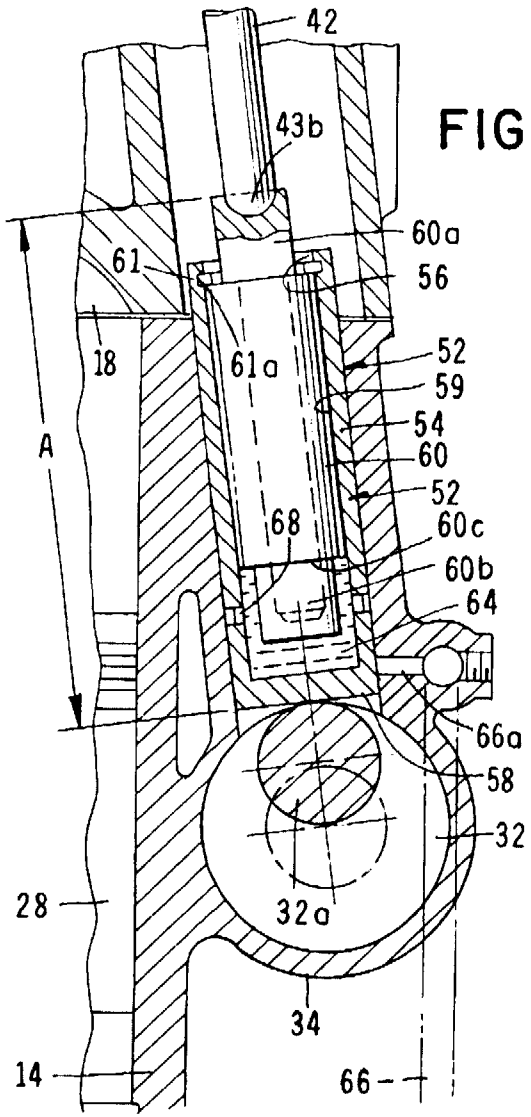
FIG. 5 is an enlarged fragmentary, cross-sectional view of the tappet assembly and camshaft portions of the apparatus illustrated in FIG. 1 showing the overall length of the tappet assembly as "A".

Oil flowing into reservoir 64 under pressure will act on shoulder 60*c* of member 60 tending to move the member upwardly within sleeve 54 against the urging of the biasing means, or spring 46, which is acting on push rod 42 (see also FIG. 8). By referring to FIG. 5, it can be observed that when the oil pressure flowing into reservoir 64 is very high, member 60 will be urged upwardly against the urging of the biasing means to a position wherein the overall length of the tappet assembly is a first distance A. When the cam lobe 32 is in the uppermost position as shown in FIG. 5 and where the overall length of the tappet assembly is at its greatest length, valve 22 will be lifted from valve seat 20, the maximum distance shown in FIG. 1. However, when the pressure of the oil flowing into reservoir 64 is low as, for example, when the engine is idling or running at low rpm, member 60 will be moved a lesser distance against the urging of the biasing means so that the overall length of the tappet assembly is a second distance "B" as shown in FIG. 6 which is substantially less than distance "A". In this instance, as is shown in FIG. 2, valve 22 will be lifted a lesser distance.

It is at once apparent that with the engine construction described in the preceding paragraphs, when the engine is running at high rpm, oil flowing from the oil pump of the engine into passageway 66 will be at a high pressure and will exert a substantial upward pressure on shoulder 60*c* of member 60. This upward pressure will overcome the downward force exerted on member 60 by spring 46 acting on push rod 42 so that member 60 will move upwardly within hollow sleeve 44. This upward movement of member 60 will, of course, increase the overall length of the tappet assembly. As the speed of the engine decreases, the pressure of the oil flowing from the oil pump "P" will also decrease causing a lesser force to be exerted on member 60. This lesser pressure being exerted on member 60 will result in the member moving upwardly a lesser distance within hollow sleeve 44 with the end result being that the overall length of the tappet assembly becomes progressively less as the speed of the engine and the pressure of the oil progressively decreases. This change in length of the tappet assembly will result in a continuous change of lift of the intake and exhaust valve of the invention and the duration during which there valves remain open. Accordingly, when the camshaft rotates into the maximum lift position shown in FIGS. 5 and 6, the valve associated with the particular tappet assembly being acted upon by the camshaft will be opened or closed an amount directly proportional to the pressure of the oil flowing into reservoir 64 which is, in turn, directly proportional to the speed of the engine.

Figure 11:
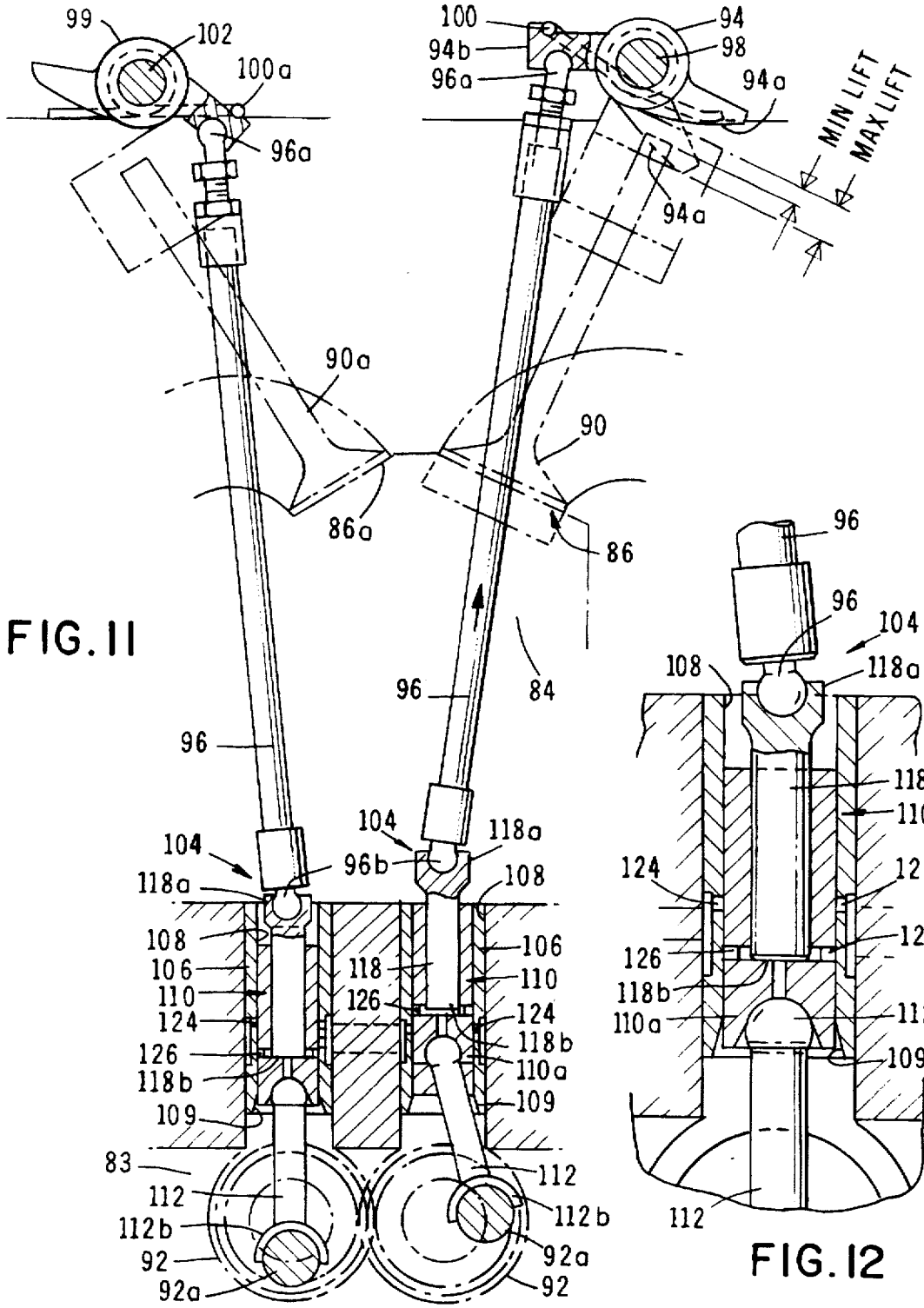
FIG. 11 is a generally diagrammatic, side-elevational, cross-sectional view of a portion of an internal combustion engine embodying an alternate form of the valve operating means of the invention for controllably operating the engine valves.
Figure 12:
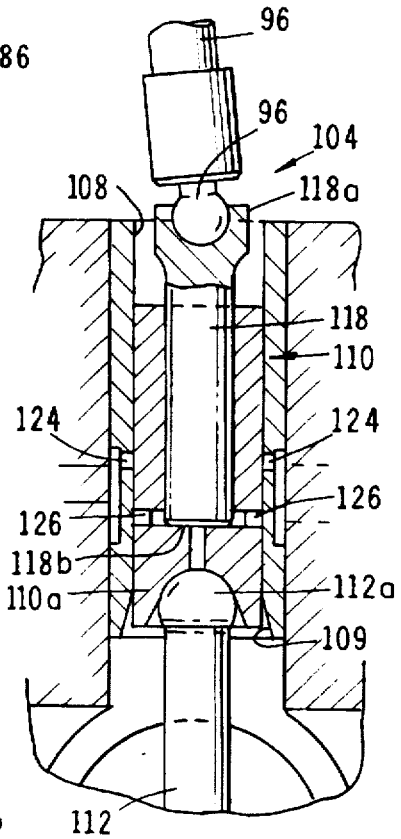
FIG. 12 is an enlarged, fragmentary, cross-sectional view similar to the lower right-hand portion of FIG. 11, but showing the camshaft having rotated further in a counter-clockwise direction.
Figure 13:
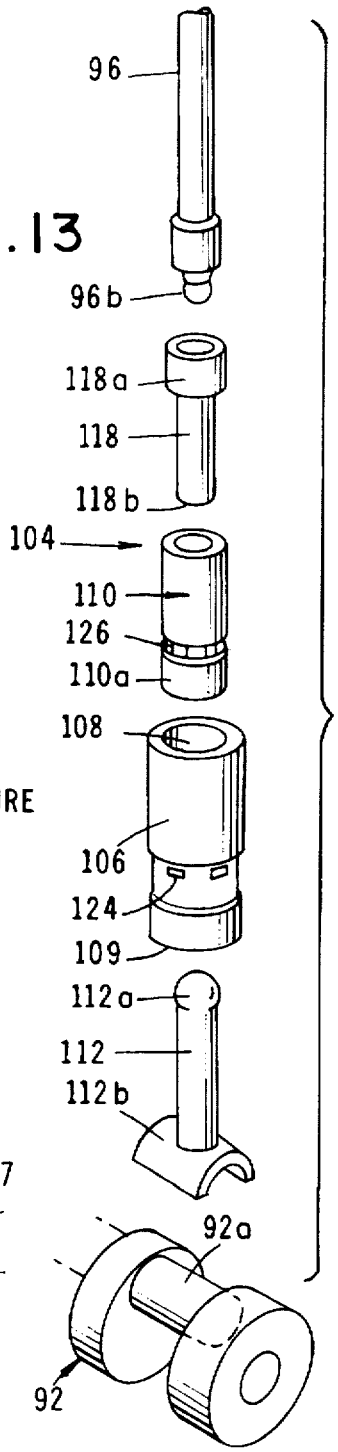
FIG. 13 is a generally perspective, exploded view of the alternate form of the valve operation means of the invention with the various components in the position shown in FIG. 11B.

Referring to FIGS. 11 through 13, a portion of an alternate embodiment of the internal combustion engine of the present invention is there illustrated. As shown in FIG. 11, the engine includes an intake portion and an exhaust portion made up of operating components of substantially identical design. As before, the engine comprises a housing having a crankcase 83 and a combustion chamber 84 (FIG. 11B) of generally conventional construction. Once again, for simplicity of explanation, the components of the intake portion of the engine will first be described. As best seen by referring to FIGS 11A and 11B and the right-hand portion of FIG. 11, a valve seat 86 is provided within combustion chamber 84 and, in cooperation with valve 90, functions to close a fuel inlet passageway to the combustion chamber. Valve 90 is movable toward and away from seat 86 in the manner illustrated in the phantom lines in FIGS. 11 and 11B.

The engine includes a crankshaft (not shown) of generally standard construction which is rotatable within crankcase 83 and is interconnected with a conventional piston by means of a connecting rod and a wrist pin (see, for example, FIGS. 1 through 3).

A rotating camshaft 92 of generally standard construction is rotated by a drive means of conventional construction which interconnects the engine crankshaft with camshaft 92 in a manner to controllably impart rotation to the camshaft as the crankshaft rotates (see, for example, FIGS. 1 through 3).

Figure 11B:
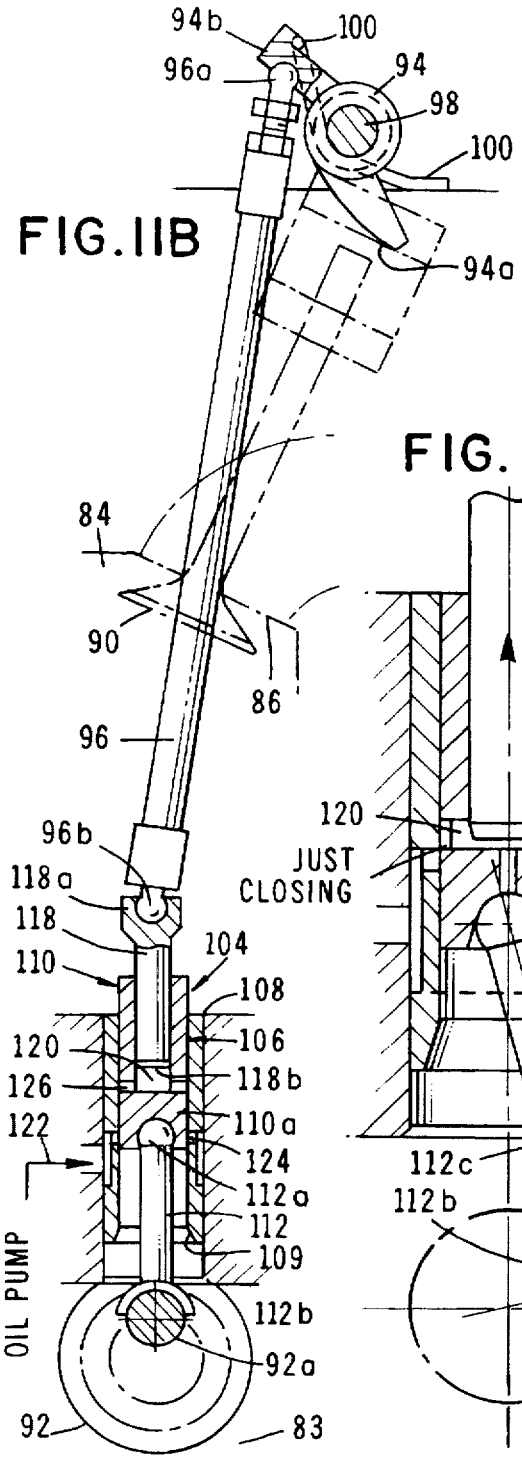
FIG. 11B is a cross-sectional view of the right-hand tappet assembly shown in FIG. 11, but showing the position of the various components when there is a zero degree angle between the crank radius and the connecting rod.

A rocker 94 is operably associated with valve 90 in the manner shown in FIGS. 11 and 11B for imparting movement to the valve in a direction toward and away from valve seat 86. As in the earlier described embodiment of the invention, rocker 94 is provided with a valve engaging curved surface 94*a* and a second spaced-apart surface 94b which is engagable with the outboard end 96*a* of a pusher rod 96. Rocker 94 pivots about a shaft 98 which also carries a biasing means shown here as a torsion spring member 100.

Referring particularly to FIG. 11, it is to be noted that, in addition to valve 90 which moves toward and away from valve seat 86 so as to control entry of fuel into the intake portion of the engine, there is provided an exhaust valve 90*a* which opens and closes valve seat 86*a* to regulate the flow of exhaust gases through the exhaust port of the exhaust portion of the engine. Similarly, a rocker 99 pivots about a shaft 102 and controls and imparts movement to exhaust valve 90*a*. Intake and exhaust valves 90 and 90*a* are of substantially identical design and operate in a conventional manner with both valves being continuously biased into a closed position by springs 100 and 100*a* respectively which are mounted on shafts 98 and 102 (FIG. 11).

Once again, the engine components described in the immediately preceding paragraphs are of standard construction and operate in a standard manner. The improvement and the unique, nonstandard aspect of the internal combustion engine of the invention comprises a novel, alternate form of valve operating means for controllably operating the intake and exhaust valves as function of engine speed. The valve operating means of this latest form of the invention is similar in many respects to that of the earlier described embodiment, but is more compact and can be used when space is limited. As before, the valve operating means comprises an assembly made up of the previously identified push rods and a variable length tappet assembly 104 which is disposed intermediate rotating camshaft 92 and the second or lower end 96*b* of the push rods. As shown in FIG. 11, a valve operating apparatus is provided to operate each of the intake and exhaust valves 90 and 90*a* respectively. These valve operating assemblies are of substantially identical construction and operate in substantially the same manner. This being the case, in the paragraphs which follow only the assembly associated with the intake valve will be described.

Figure 11A:
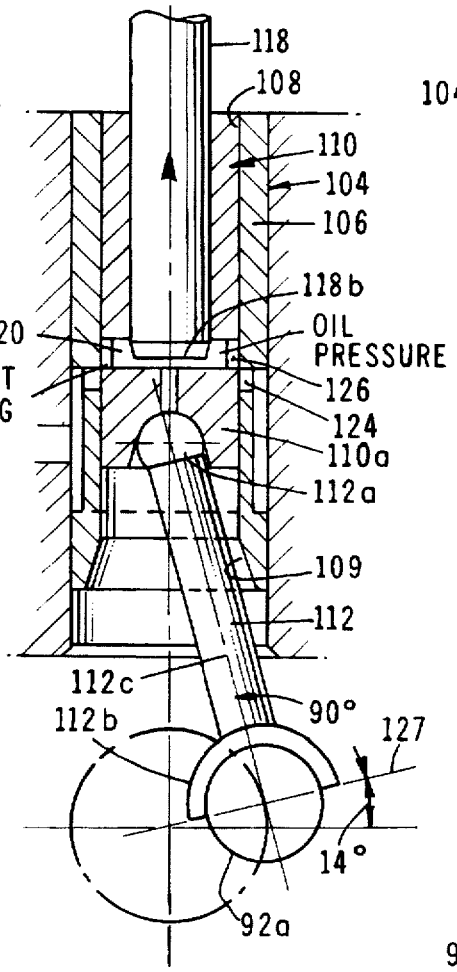
FIG. 11A is an enlarged, fragmentary, cross-sectional view of the right-hand tappet assembly shown in FIG. 11, but showing the position of the various components when there is a 90 degree angle between the crank radius and the connecting rod at which point no mass forces are being exerted in a vertical direction.

Turning particularly to FIGS. 11A, 11B and 13, the variable length tappet assembly 104 can be seen to comprise a hollow sleeve 106 having first and second open ends 108 and 109. Reciprocally movable within sleeve 106 is an elongated, piston-like reciprocating member 110 which engages the upper end 112*a* of a coupling assembly 112. The lower semicircular shaped end 112*b* of the coupling assembly is, in turn, engagable with a selected lobe 92*a* of camshaft 92 in the drawings. Also reciprocally movable within sleeve 106 is a push rod engaging member 118 which includes a first cup-like portion 118*a* which is adapted to engage end 96*b* of push rod 96. Member 118 also includes a spaced-apart, flat end portion 118*b* which resides within portion 110*a* of member 110.

As best seen in FIG. 11B, end portion 118*b* of push rod engaging member 118 forms, in cooperation with reciprocating member 110, an oil reservoir 120. As before, and as indicated in FIG. 116, oil reservoir 120 communicates with the oil pump of the engine via an oil flow passageway 122 which also forms a part of the valve operating means of the present form of the invention. As previously explained, reservoir 120 can communicate with oil passageway 122 only when member 110 is in the second almost instantaneous position just prior to the components reaching the position shown in FIG. 11A, wherein a circumferentially extending fluid inlet 124, which is formed in the wall of sleeve 106, is in alignment with the fluid inlet portion 126 of member 110. Referring to FIG. 11A, it is to be noted that inlet 124 is just closing due to upward movement of reciprocating member 110 within sleeve 106 from a first to a second location. In this position, the angle between the crank radius 127 and the axis 112*c* of the coupling assembly 112 is approximately 90 degrees. In this substantially instantaneous position, the cam lobe 92*a* is exerting no upward force on piston-like element 110, and both the intake and exhaust valves 90 and 90*a* are in their closed position (FIG. 11). Stated another way, at this instant in time at which oil inlet 124 aligns with reservoir inlet 126, oil under pressure flowing through passageway 122 can flow into reservoir 120. As illustrated in FIG. 11B, passageway 122 is in communication with the oil pump of the engine which is designed to deliver oil to the engine components at a pressure, which is in direct proportion to the speed of the engine. Accordingly, when inlet 124 is aligned with inlet 126, the pressure of oil flowing into reservoir 120 from the oil pump will vary directly with the speed of the engine.

Oil flowing into reservoir 120 under pressure will act on member 118 tending to move the member upwardly within the internal chamber of member 110 in the manner shown in FIG. 11B. As previously discussed, when the oil pressure flowing into reservoir 120 is very high, member 118 will be urged upwardly against the urging of the biasing means to a position exemplified in FIG. 11B. When the cam lobe 92*a* is also in the uppermost position shown in FIG. 11B and where the overall length of the tappet assembly is at its greatest length, valve 90 will be lifted from valve seat 86, the maximum distance shown in FIG. 11B. However, when the pressure of the oil flowing into reservoir 120 is low as, for example, when the engine is idling or running at low rpm, member 118 will be moved a lesser distance against the urging of the biasing means so that the overall length of the tappet assembly is substantially less than shown in FIG. 11B. In this instance, the components may be in the position shown in FIG. 12, wherein valve 90 will, of course, be lifted a lesser distance.

By way of summary, with the alternate engine construction described in the immediately preceding paragraphs, when the engine is running at high rpm, oil flowing from the oil pump of the engine into passageway 122 will be at a high pressure and will exert a substantial upward pressure on member 118. This upward pressure will overcome the downward force exerted on member 118 by spring 100 acting on push rod 96 so that member 118 will tend to move upwardly relative to member 110. This upward movement of member 118 will, of course, increase the overall length of the tappet assembly and, at maximum engine speed, will open valve 90 the maximum distance of lift as illustrated by the phantom lines in FIG. 11. As the speed of the engine decreases, the pressure of the oil flowing from the oil pump toward reservoir 120 will also decrease causing a lesser force to be exerted on member 118. This lesser pressure being exerted on member 118 will result in the member moving upwardly a lesser distance within member 110 with the end result being that the overall length of the tappet assembly becomes progressively less as the speed of the engine and the pressure of the oil progressively decreases and will move the valve 90 to the minimum lift position shown in FIG. 11. As shown in FIG. 11, this change in length of the tappet assembly will result in a continuous change of lift of the intake and exhaust valve of the invention and the duration during which there valves remain open.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. In an internal combustion engine which includes a combustion chamber having a valve seat, a valve movable toward and away from the valve seat, a rotating crankshaft, a rotating camshaft operably interconnected with the rotating crankshaft, an oil pump for pumping oil to the engine components at varying pressure depending upon the speed of the engine, a rocker operably associated with the valve for imparting substantially linear movement to the valve, the improvement comprising a valve operating apparatus for controllably operating the valve comprising:

(a) a push rod having first and second ends, said first end being in engagement with the rocker;

(b) a variable length tappet assembly disposed intermediate the rotating camshaft and said second end of said push rod, said tappet assembly comprising:

(i) a hollow sleeve having a first open end and a second closed end in engagement with the rotating camshaft to cause movement of said hollow sleeve between a first position wherein the rotating camshaft exerts substantially no force on said hollow sleeve to a second position, said hollow sleeve having an internal chamber having an inlet in communication with the oil pump only when said hollow sleeve is in said first position; and (ii) a push rod engaging member reciprocally movable within said internal chamber of said hollow sleeve between a first location and a second location in response to oil flowing through said inlet of said internal chamber of said hollow sleeve, said push rod engaging member having a first end portion in engagement with said second end of said push rod and a spaced apart second end portion; and (c) operating means operably associated with said variable length tappet assembly for varying the length of said tappet assembly as a function of the speed of the engine, said operating means including an oil passageway interconnecting the oil pump with said inlet of said internal chamber of said hollow sleeve.

2. A valve operating apparatus as defined in claim 1 in which said second end portion of said push rod engaging member includes a reduced diameter portion which forms, in cooperation with said hollow sleeve, an oil reservoir, said oil flow passageway being periodically in communication with said oil reservoir.

3. A valve operating apparatus as defined in claim 1 further including biasing means carried by said rocker for urging said push rod engaging member toward said second location.

4. A valve operating apparatus as defined in claim 1 in which said first end portion of said push rod engaging member includes a reduced diameter portion defining a cylindrical surface and in which said operating means further includes alignment means disposed within said internal chamber for engagement with said cylindrical surface for guiding travel of said push rod engaging member within said hollow sleeve.

5. An internal combustion engine comprising:

(a) a housing having a crankcase and a combustion chamber having a valve seat;

(b) a valve movable toward and away from said valve seat;

(c) a crankshaft rotatable within said crankcase;

(d) a piston connected to said crankshaft for reciprocal movement within said combustion chamber;

(e) a rotating camshaft operably connected to said crankshaft;

(f) a rocker operably associated with said valve for imparting movement thereto;

(g) oil pumping means for pumping oil under pressure toward said crankshaft at varying pressure depending upon the speed of rotation of said crankshaft; and (h) a valve operating means for operating said valve to move said valve relative to said valve seat to an extent proportional to the speed of rotation of said crankshaft, said valve operating means comprising:

(i) a push rod having first and second ends, said first end being in engagement with said rocker; and (ii) oil pressure actuated tappet means in communication with said oil pumping means and disposed intermediate said rotating camshaft and said second end of said push rod for controllably moving said push rod in response to oil under pressure flowing from said oil pumping means, said tappet means comprising:

a. a hollow sleeve having a first open end and a second closed end in engagement with the rotating camshaft to cause movement of said hollow sleeve between a first position wherein the rotating camshaft exerts substantially no force on said hollow sleeve to a second position, said hollow sleeve having an internal chamber having an inlet in communication with the oil puma only when said hollow sleeve is in said first position; and b. a push rod engaging member reciprocally movable within said internal chamber of said hollow sleeve between a first location and a second location in response to oil flowing through said inlet of said internal chamber of said hollow sleeve, said push rod engaging member having a first end Portion in engagement with said second end of said push rod and a spaced apart second end portion.

6. An internal combustion engine as defined in claim 5, further including an oil flow passageway operably interconnecting said oil pumping means with said tappet means.

7. An internal combustion engine as defined in claim 6 in which said second end portion of said push rod engaging member includes a reduced diameter portion which forms, in cooperation with said hollow sleeve, an oil reservoir, said oil flow passageway being in communication with said oil reservoir.

8. An internal combustion engine as defined in claim 7 further including biasing means carried by said rocker for urging said push rod engaging member toward said second location.

9. In an internal combustion engine which includes a combustion chamber having a valve seat, a valve movable toward and away from the valve seat, a rotating crankshaft, a rotating camshaft operably interconnected with the rotating crankshaft, an oil pump for pumping oil to the engine components at varying pressure depending upon the speed of the engine, a rocker operably associated with the valve for imparting substantially linear movement to the valve, the improvement comprising a valve operating apparatus for controllably operating the valve comprising:

(a) a push rod having first and second ends, said first end being in engagement with the rocker;

(b) a variable length tappet assembly disposed intermediate the rotating camshaft and said second end of said push rod, said tappet assembly comprising:

(i) a hollow sleeve having an internal chamber, first and a second open ends and an oil inlet;

(ii) a coupling assembly having first and second ends, said second end being in engagement with the rotating camshaft;

(iii) a reciprocating member in engagement with said coupling assembly, said reciprocating member being reciprocally movable by said coupling assembly within said internal chamber of said hollow sleeve between a first location and a second location, said reciprocating member having an internal chamber having an inlet indexable with said oil inlet of said hollow sleeve when said reciprocating member is in said second location; and (iv) a push rod engaging member reciprocally movable within said reciprocating member between a first and second location in response to oil flowing through said oil flow passageway, said push rod engaging member having a first end portion in engagement with said second end of said push rod and a spaced-apart second end portion disposed within said internal chamber of said reciprocating member; and (c) operating means operably associated with said variable length tappet assembly for varying the length of said tappet assembly as a function of the speed of the engine, said operating means comprising an oil passageway operably interconnecting the oil pump with said tappet assembly, said oil inlet of said hollow sleeve of said tappet assembly being in communication with said oil flow passageway.

10. In an internal combustion engine which includes a combustion chamber having a valve seat, a valve movable toward and away from the valve seat, a rotating crankshaft, a rotating camshaft operably interconnected with the rotating crankshaft, an oil pump for pumping oil to the engine components at varying pressure depending upon the speed of the engine, a rocker operably associated with the valve for imparting substantially linear movement to the valve, the improvement comprising a valve operating apparatus for controllably operating the valve comprising:

(a) an oil passageway having an inlet end in communication with the oil pump and an outlet end;

(b) a push rod having first and second ends, said first end being in engagement with the rocker; and (c) a variable length tappet assembly disposed intermediate the rotating camshaft and said second end of said push rod, said tappet assembly comprising:

(i) a hollow sleeve having a first open end and a second closed end, said hollow sleeve being movable by the rotating camshaft between a first position wherein the rotating camshaft is exerting substantially no forces causing movement of said hollow sleeve to a second position, said hollow sleeve having an internal chamber, first and second open ends and an oil inlet indexable with said outlet end of said oil flow passageway only when said hollow sleeve is in said first position; and (ii) a push rod engaging member reciprocally movable within said internal chamber of said hollow sleeve between a first location and a second location in response to oil flowing through said oil flow passageway, said push rod engaging member having a first end portion in engagement with said second end of said push rod and a spaced apart second end portion.

11. A valve operating apparatus as defined in claim 10 in which said second end portion of said push rod engaging member includes a reduced diameter portion which forms, in cooperation with said hollow sleeve, an oil reservoir.

12. A valve operating apparatus as defined in claim 10 further including biasing means carried by said rocker for urging said push rod engaging member toward said second location.

13. A valve operating apparatus as defined in claim 10 in which said first end portion of said push rod engaging member includes a reduced diameter portion defining a cylindrical surface and in which said operating means further includes alignment means disposed within said internal chamber for engagement with said cylindrical surface for guiding travel of said push rod engaging member within said hollow sleeve.

* * * * *